United States Patent [19]

Hammes et al.

[11] Patent Number: 4,736,862

[45] Date of Patent: Apr. 12, 1988

[54] DRUM WITH BUNGS

[75] Inventors: Theo Hammes, Cologne; Dietmar Przytulla, Sindorf, both of Fed. Rep. of Germany

[73] Assignee: Mauser-Werke, GmbH, Bruhl, Fed. Rep. of Germany

[21] Appl. No.: 277,715

[22] Filed: Jun. 26, 1981

[30] Foreign Application Priority Data

Jul. 1, 1980 [DE] Fed. Rep. of Germany ..... 3024810

[51] Int. Cl.[4] ..... B65D 8/04

[52] U.S. Cl. ..... 220/73; 220/5 R

[58] Field of Search ..... 220/67, 73, 72, 1 R, 220/5 R, DIG. 1, 70, 74; 222/108; 264/534

[56] References Cited

U.S. PATENT DOCUMENTS 3,985,257 10/1976 Shaffer et al. ..... 220/1 R
4,228,122 10/1980 Hammes ..... 264/534
4,228,911 10/1980 Hammes ..... 220/1 R

*Primary Examiner*—Henry J. Recla
*Assistant Examiner*—David Voorhees
*Attorney, Agent, or Firm*—Pennie & Edmonds

[57] ABSTRACT

The invention is directed to a molded drum of thermoplastic material, in which the bungs are arranged in troughs on the drum-head and in which the troughs are open toward an adjacent L-shaped roller chime formed directly from the drum-body at some distance below the top end of the drum.

2 Claims, 1 Drawing Sheet

DRUM WITH BUNGS

BACKGROUND OF THE INVENTION

The invention relates to molded drums of thermoplastic material having bungs arranged in trough-shaped indentations in the head end of the drum and roller chimes of an L-shaped section formed directly from the drum shell at some distance away from the head and bottom ends of the drum.

The blowing mold for the manufacture of drums with bungs consists of two mold halves which are separable along a vertical plane, that is, the plane extending in the axial direction of the drum. The upper and lower region of each mold half is horizontally divided to provide mold parts which slide one into the other.

The extrusion head of the blowing machine delivers a parison of extruded plastic between the mold halves which are in the separated position so that the parison can enter therebetween. At this time, the mold parts in each mold half which slide relative to one another are opened. After the parison is lowered in the axial direction of the drum into the mold, the two mold halves are closed. In the closed position the mold halves clamp the previously extruded parison at what will be the head and bottom ends of the drum creating a seam across both clamped portions of the parison. The blowing process is then commenced. Molding apparatus of this type is conventional. See, for example, U.S. Pat. No. 3,985,257 for "Blow Molded Industrial Drum" and U.S. Pat. No. 3,050,773 for "Process and Apparatus for Manufacturing Blown Articles". In this type of molding apparatus air blown into the mandrel expands the parison so that it is pressed outwardly against the inner wall of the closed mold and, as a result, assumes the predetermined shape of the drum. With the upper and lower mold parts of each mold half disposed in an open position, the material of the parison enters into the recesses formed by the open mold parts. With such a mold construction, radially outwardly extending channels are formed on the container during the blow molding operation. These channels open toward the inside of the container.

Subsequently, the mold parts are moved relative to one another into a closed position. The mold parts which can be moved relative to one another are shaped to provide the roller chime configuration and the material of the channels pressed into the recesses provided by the mold parts forms the roller chimes when the mold parts are moved relative to one another. The roller chimes have an L-shaped cross section each with an outwardly extending horizontal web or leg and with a vertical leg extending from the outer end of the horizontal leg in either the upward or downward direction depending upon the location of the chimes.

The shape of the roller chime is of special significance. The gripping device for lifting and carrying the drum grasps with its tong arms under the horizontally outwardly projecting roller chime leg and behind the vertically extending leg. Accordingly, the vertical leg of the upper roller chime, that is, the chime adjacent the drum head, extends upwardly from the horizontal leg while the vertical leg of the lower chime, that is, the chime adjacent the bottom end of the drum, is directed downwardly from the horizontal leg.

Due to the varying material distribution in the drum body, difficulties occur in the formation of the roller chimes. In the region of the dividing seams in the mold, the material of the extruded parison is doubled when the mold halves are moved to the closed position and the material has been squeezed into a clamped seam extending diametrically across the closed mold at both the top and bottom of the mold. During the blowing process, the parison is stretched and those regions which move in a direction perpendicularly away from the squeezed seam become significantly thinner. In the formation of the roller chimes in the upper and lower displaceable parts of each mold half, different volumes of material are available. As a result, due to the larger amount of the material in the region of the mold dividing seams, the displaceable mold parts cannot close completely and, thus, a satisfactory formation of the roller chimes in the region of the thinner areas becomes impossible. Because of the gripping devices used in lifting and transporting the drums, a satisfactory formation of the roller chimes is required.

For this reason, dimensioning of the mold (and thus of the roller chimes) has been effected in such a manner whereby the same depth of the grooves of the roller chimes is maintained about the entire circumference of the drum. This is effected by forming the horizontal legs of the chimes with a thickness that decreases from the dividing seams in the mold for an angular extent of 90° until the thickness reaches a minimum corresponding to the thickness of the drum body and then increases steadily to the region of the next mold dividing seam. The horizontal leg of the roller chime adjacent the head end of the drum where the region of largest material accumulation occurs is widenend, that is, in the radial direction from the drum, by providing indentations in the head end directed toward the interior of the drum.

For producing the desired horizontal leg thickness, the part of the mold which forms the outer surface of the horizontal leg has a wave-like contour with the wave troughs arranged in the region of a larger accumulation of the material and the wave crests located in the region of the lesser material accumulation. Accordingly, the movable mold parts of each mold half can be closed completely without pressing the larger material volume into the interior of the drum. Furthermore, the shape of the mold part forming the outer horizontal leg surface guarantees the uniform or constant height of the vertical leg of each roller chime around its circumference. Drums of the above construction are disclosed in U.S. Pat. No. 4,228,911, assigned to the same assignee as the present application.

To prevent the roller chimes from being damaged during rolling of the drum, that is, when the drum is rolled on the ground at a slant, or when a filled drum is accidentally dropped, a so-called crasher zone is provided by locating the roller chimes at a distance spaced from the top and bottom ends of the drum. Also, in order to prevent the bungs from being damaged, they are located in recessed areas or troughs in the head end of the drum. Conventionally, the bungs are located on diametrically opposite sides of the top end of the drum in the region of the mold dividing seams.

With the drum construction as described above, the closer the roller chime comes to the top end of the drum, the larger become the accumulations of material at the mold dividing seams and in the adjacent bung trough areas. If a favorable distribution of material in the roller chime is achieved in the manner described above, unfavorable stress conditions result in the transitional zone of the horizontal leg of the chime into the bottom of the bung troughs. This is so because the bottom of the troughs are, by virtue of their proximity to the mold dividing seams, located where nearly no stretching of material occurs during the expansion of the parison in the mold, and thus the largest quantity of material remains after blowing of the drum. In order to control this supply of material during the closing of the mold, it has been the practice to form a raised bead of material in the base of the trough between the bung and the roller chime, thus precluding a smooth transition between the base of the trough and the horizontal leg of the roller chime. The formation of the bead has the effect of reinforcing the base of the trough.

Such a measure can prove somewhat disadvantageous inasmuch as during impact stress, in particular during the sidewise impact of a filled drum, during a so-called body throw, cracks can occur in the area between the roller chime and the outside edge of the bead of material rising above the base of the trough. Due to the reinforcing of the trough base by the bead of material and because of the shearing stress resulting therefrom in the transition between the non-rigid drum shell, the roller chime, and the reinforced and therefore rigid base of the trough, the drum can burst in the direction of its circumference when under impact stress.

SUMMARY OF THE INVENTION

It is a primary object of the present invention to reduce the stress peaks between the roller chime and the drum head end by means of evening out the material in the area of the base of the troughs. This, in turn, will reduce the danger of partial cracking.

This task is solved according to the invention in that the bases of the troughs are open towards the corresponding roller chime and run smoothly into the horizontal leg of the roller chime. Also, the upper surface of the bottom of each trough forms, with its front part, a smooth plane with the surface of the horizontal leg of the roller chime.

Through this measure, stiffening in the outer dividing seam area is neutralized. The trough bottom can therefore evade impact stress. Impact force is eliminated through elastic deformation of the material. The possibility of the drum cracking at the transition between the trough bottom and the roller chime in the area of the dividing seams is thus eliminated.

Figure 1:
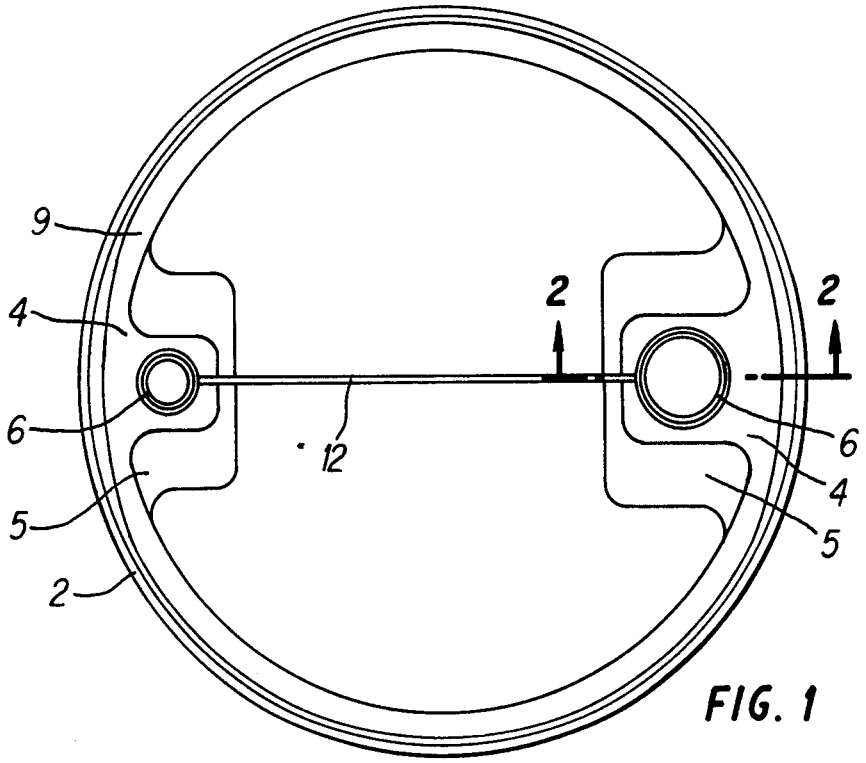
FIG. 1 shows a top view of a drum with bungs.

The body of the drum is marked 1. The roller chime 10 is formed radially outwards by of the drum body 1 and includes a vertical leg 2 and a horizontal leg 3. The roller chime shown in the drawing is located adjacent the head end of the drum. A similar chime will be formed adjacent the bottom end of the drum. In this regard, see the above-mentioned U.S. Pat. No. 4,228,911 and also U.S. Pat. No. 4,228,122, assigned to the same assignee as the present application.

Figure 2:
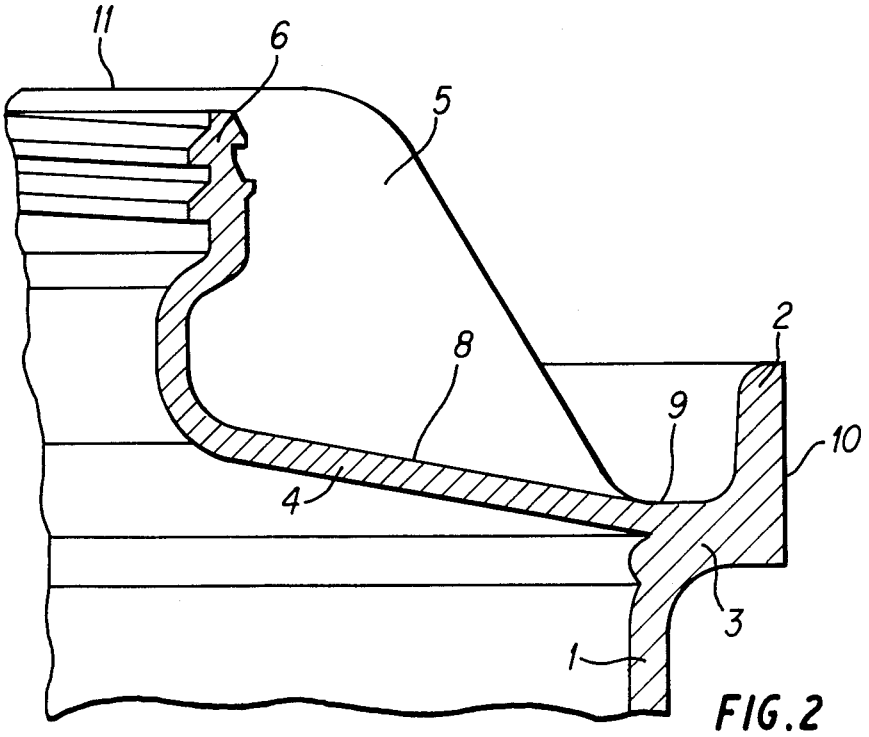
FIG. 2 shows the enlarged section taken along lines 2—2 of FIG. 1.

As shown in FIG. 2, the drum head 11 extends above the roller chime 10. The same applies to the drum bottom not shown in the drawing. This is done so that the roller chimes will be protected when mishandled or several drums are stacked one on top of the other. The bungs 6 are arranged in the troughs 5 of the drum head 11. The troughs 5 and the bungs 6 are disposed on diametrically opposite sides of the drum in the region of the mold dividing seam 12.

The troughs 5 are opened towards the roller chime 10 with the trough bottom 4 running level, (that is, having an even thickness or distribution of the material) into the horizontal leg 3 of the roller chime 10. Also, as best shown in FIG. 2, the upper surface 8 of the trough bottom 4 forms a smooth plane with the upper surface 9 of the horizontal leg 3 of the roller chime.

We claim:

1. In a blow-molded drum constructed of thermoplastic material and having bungs arranged in troughs in the drum head end in the region of the mold dividing seam and a roller chime of L-shaped cross section formed directly from the drum body at a distance below the head end, said roller chimes having a horizontal leg extending radially outwardly of the drum body and a vertical leg at the end of the horizontal leg, the improvement wherein:

(a) the troughs are open toward the roller chime with the bottom wall merging smoothly with the horizontal leg of the chime; and (b) the bottom wall of each trough is of uniform thickness as measured at different locations in a radial direction toward the roller chime.

2. A blow-molded drum with bungs according to either of claim 1, wherein:

(a) the upper surface of the bottom of each trough forms a downwardly sloping plane merging smoothly with the upper surface of the horizontal leg.

* * * * *